US006558468B2

(12) United States Patent
Masaki et al.

(10) Patent No.: US 6,558,468 B2
(45) Date of Patent: May 6, 2003

(54) CONVEYANCE APPARATUS FOR COATING

(75) Inventors: Yuji Masaki, Kumamoto (JP); Hidenobu Nishida, Kumamoto (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 142 days.

(21) Appl. No.: 09/753,663

(22) Filed: Jan. 4, 2001

(65) Prior Publication Data

US 2001/0015172 A1 Aug. 23, 2001

(30) Foreign Application Priority Data

Jan. 19, 2000 (JP) ..... 2000-010976

(51) Int. Cl.[7] ..... B05B 13/02

(52) U.S. Cl. ..... 118/324; 118/500; 118/305; 118/309

(58) Field of Search ..... 118/324, 500, 118/305, 309, 326; 198/317, 318, 369.2, 369.3, 468.6, 441

(56) References Cited

U.S. PATENT DOCUMENTS 3,648,821 A * 3/1972 Rudolph ..... 198/378
4,765,270 A * 8/1988 Faber ..... 118/102

FOREIGN PATENT DOCUMENTS

JP 2111481 4/1990
JP 6104920 12/1994

* cited by examiner

*Primary Examiner*—Laura Edwards
*Assistant Examiner*—Yewebdar T. Tadesse
(74) *Attorney, Agent, or Firm*—Birch, Stewart, Kolasch & Birch, LLP

(57) ABSTRACT

A workpiece 1 is supported on a conveyor 2 through a carrier 3. A supporting portion of the workpiece 1 is vertically and horizontally rotatable to change its position to a floor conveyor position, an overhead conveyor position, and a side conveyor position. The workpiece 1 is first moved to enter a spray booth 30 in the floor conveyor position (①) and then vertically rotated to the overhead conveyor position where the bottom portion thereof faces upward. An underside coating is performed on the lower portion of a car body by a spray apparatus 31 for which the nozzle position is situated lower (②). The workpiece 1 is then horizontally rotated to the side conveyor position where the left-hand side of the car body faces upward and an L-side coating is performed on the left-hand side of the car body by the same spray apparatus 31 as above (③). Subsequently, the workpiece 1 in the side conveyor position is vertically rotated 180° to the side conveyor position where the right-hand side of the car body faces upward and an R-side coating is performed on the right-hand side of the car body by a spray apparatus 32 for which the nozzle position is situated higher than the other (④). In addition, the workpiece 1 is horizontally rotated from this position to the upright position so as to return to the original floor conveyor position, wherein a top-side coating is performed on the upper surface of the car body by the spray apparatus 32 (⑤). Thus, all surfaces to be coated can be coated in a level plane.

7 Claims, 9 Drawing Sheets

CONVEYANCE APPARATUS FOR COATING

BACKGROUND OF THE INVENTION

1. Field of the Invention

The present invention relates to a conveyance apparatus for coating in which a workpiece which is supported on a conveyor can be coated while its position being changed, and more particularly to a conveyance apparatus which is suitable for high quality spray coating.

2. Description of the Prior Art

In a coating line for a vehicle, there are many treating processes such as pretreatment, electrodeposition, washing, coating, and drying. A workpiece is transferred among these treating processes by a conveyor. The workpiece is usually supported on a floor conveyor that is provided on a floor or supported in a condition where it is hung from an overhead conveyor that is provided overhead. Also, in the case of electrodeposition coating, to obtain a fine coating quality, it is known that the workpiece must be rotated in an electrodeposition paint tank so that its position is changed to a successive variety of positions (e.g. see Japanese Patent Publication No. Hei 6-104920 and Japanese Unexamined Patent Publication No. Hei 2-111481).

In the case of spray coating, since the workpiece is coated while being conveyed by the overhead conveyor in a spray booth, a spray apparatus side must be positioned corresponding to a fixed workpiece position during painting. In this case, a region remains in which coating is difficult, and modified or additional coating work is required. There is also a part where coating is inefficient, relating to conveyance by the overhead conveyor. Unlike a dipping treatment such as electrodeposition coating where simple rotation of the workpiece is required, it is difficult to perform satisfactory coating of the region where spray painting is difficult.

SUMMARY OF THE INVENTION

It is therefore an object of the present invention to solve the above-mentioned disadvantages.

To solve the above-noted disadvantages, according to the present invention, a conveyance apparatus is provided for spray-coating a workpiece which is supported on a conveyor by means of a carrier while passing through a spray booth, the conveyance apparatus for coating being characterized in that a position control mechanism which is capable of changing the position of the workpiece to more than one of a floor conveyor position, an overhead conveyor position, or a side conveyor position is provided, and the workpiece position is controlled by the position control mechanism so that all surfaces to be coated are turned to face a nozzle of a spray apparatus.

The position control mechanism can be constructed to be capable of vertical and horizontal rotation. It can also be constructed so that all the surfaces to be coated are coated in a level plane.

According to the present invention, a position control mechanism is provided that can change the position of a workpiece to more than one of a floor conveyor position, an overhead conveyor position, or a side conveyor position. By continuously changing the position of the workpiece to more than one of these positions in combination, the workpiece position can be controlled so that all surfaces to be coated face in the direction of a nozzle of a spray apparatus. As a result, even though the workpiece passes through a spray booth while being supported on the same conveyor, the workpiece is controlled to occupy the most suitable workpiece position so that all surfaces to be coated are spray-coated in a satisfactory condition. It is therefore possible to improve the efficiency of the spray painting.

Also, if the position control mechanism enables the vertical and horizontal rotation, it is possible to perform more complicated position control in which the position of the workpiece is changed to more than one of the floor conveyor position, the overhead conveyor position, or the side conveyor position. Thus, more accurate coating can be performed. By keeping the workpiece in the side conveyor position, each surface can be coated in a level plane. It is therefore possible to form a satisfactory coating film by spray painting from a nozzle situated above the workpiece.

BRIEF DESCRIPTION OF THE DRAWINGS

The above and other objects, features and advantages of the present invention will become more apparent from the following description when taken in conjunction with the accompanying drawings.

DETAILED DESCRIPTION OF THE PREFERRED EMBODIMENTS

Figure 1:
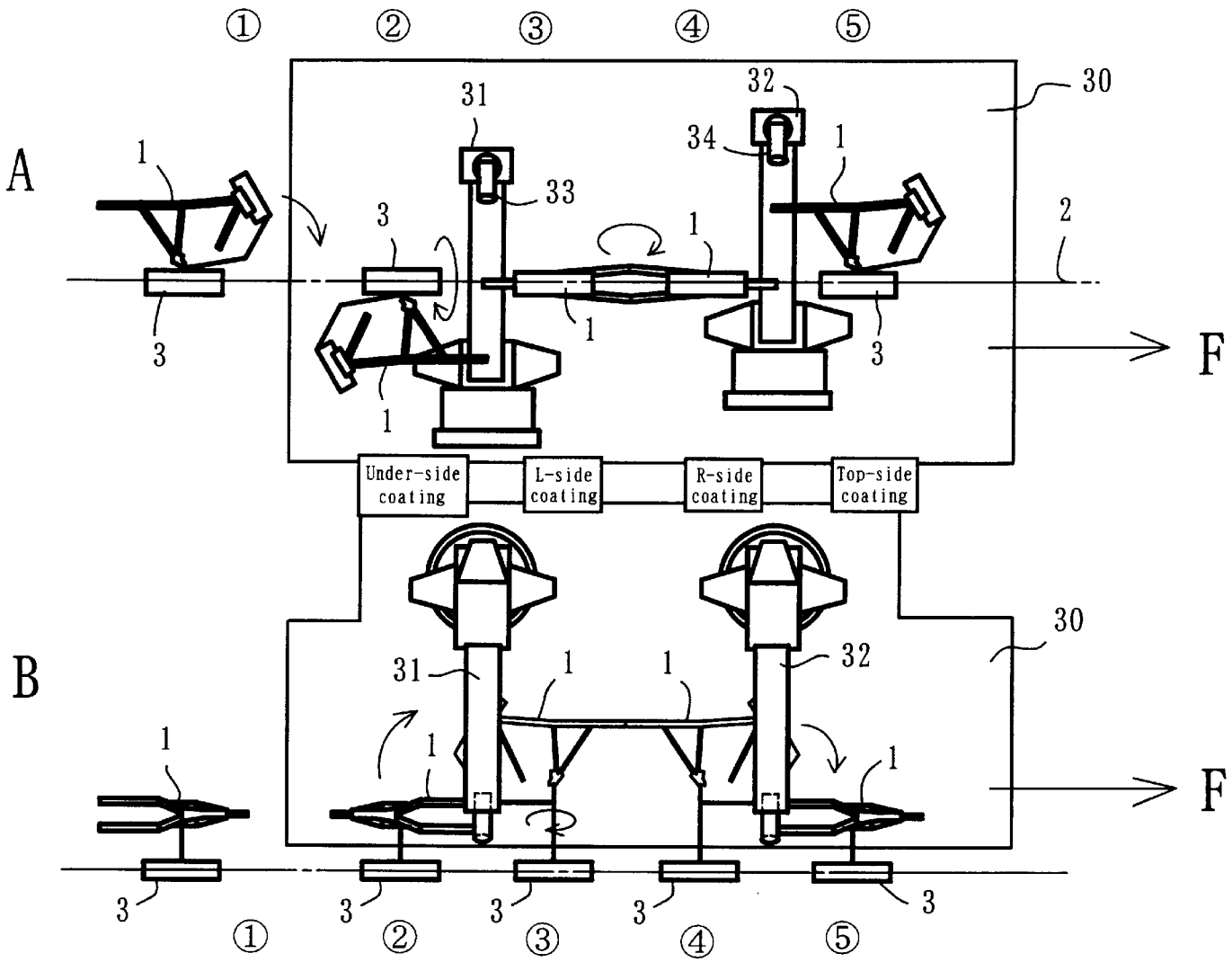
FIG. 1 is a process chart for a finish coating line according to a first embodiment (FIGS. 1 to 7)
Figure 2:
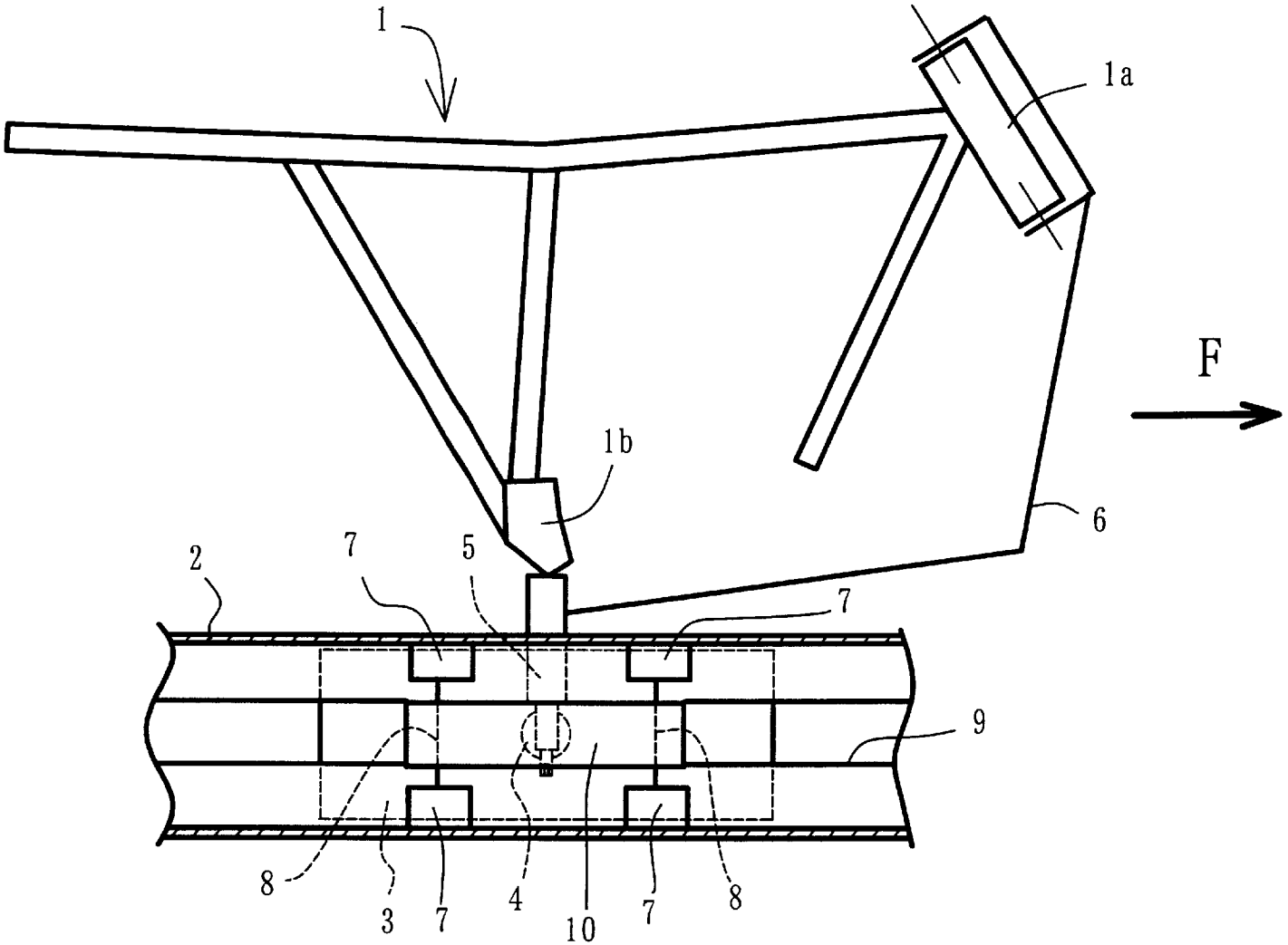
FIG. 2 is a side view showing a floor conveyor position.
Figure 3:
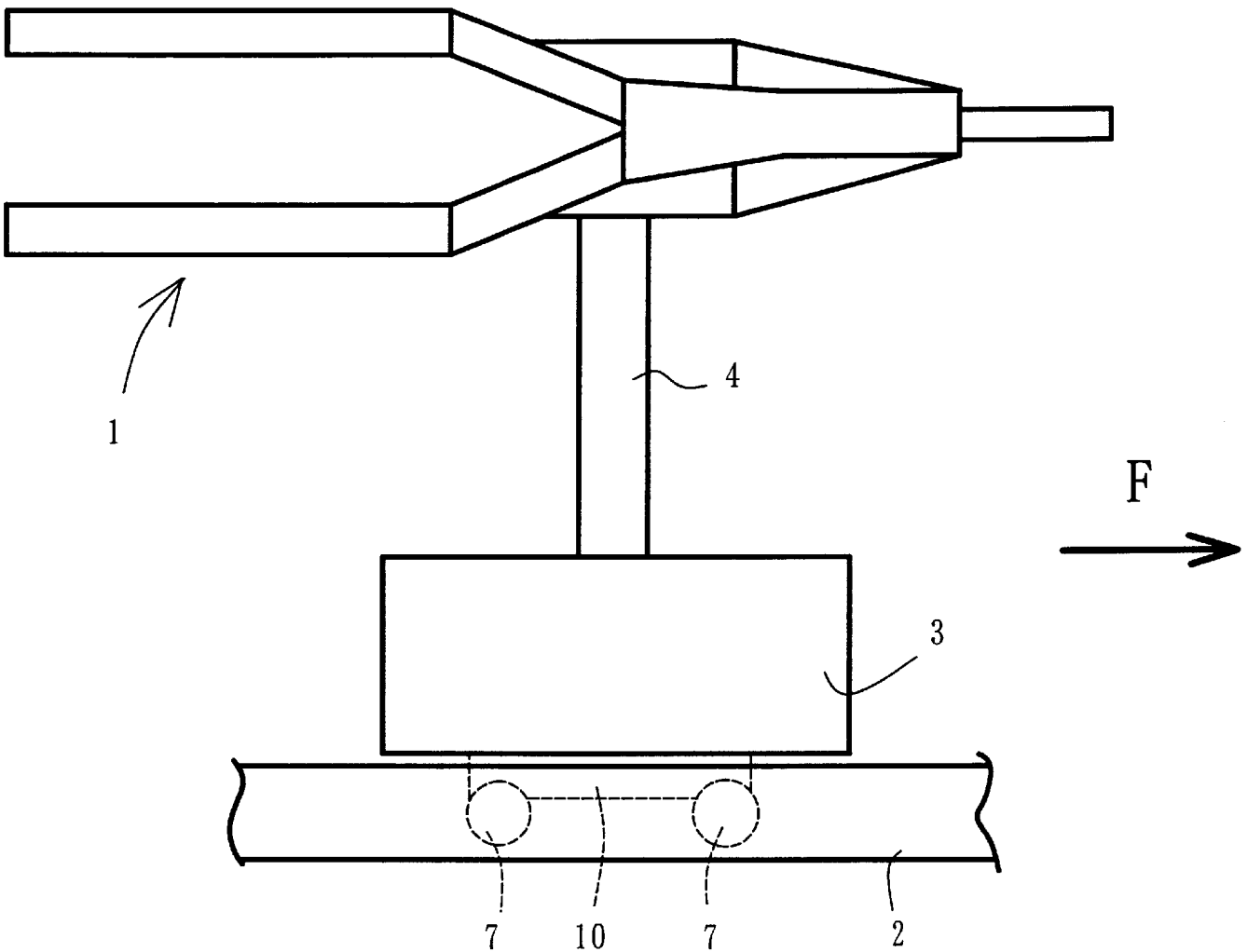
FIG. 3 is plan view thereof.
Figure 4:
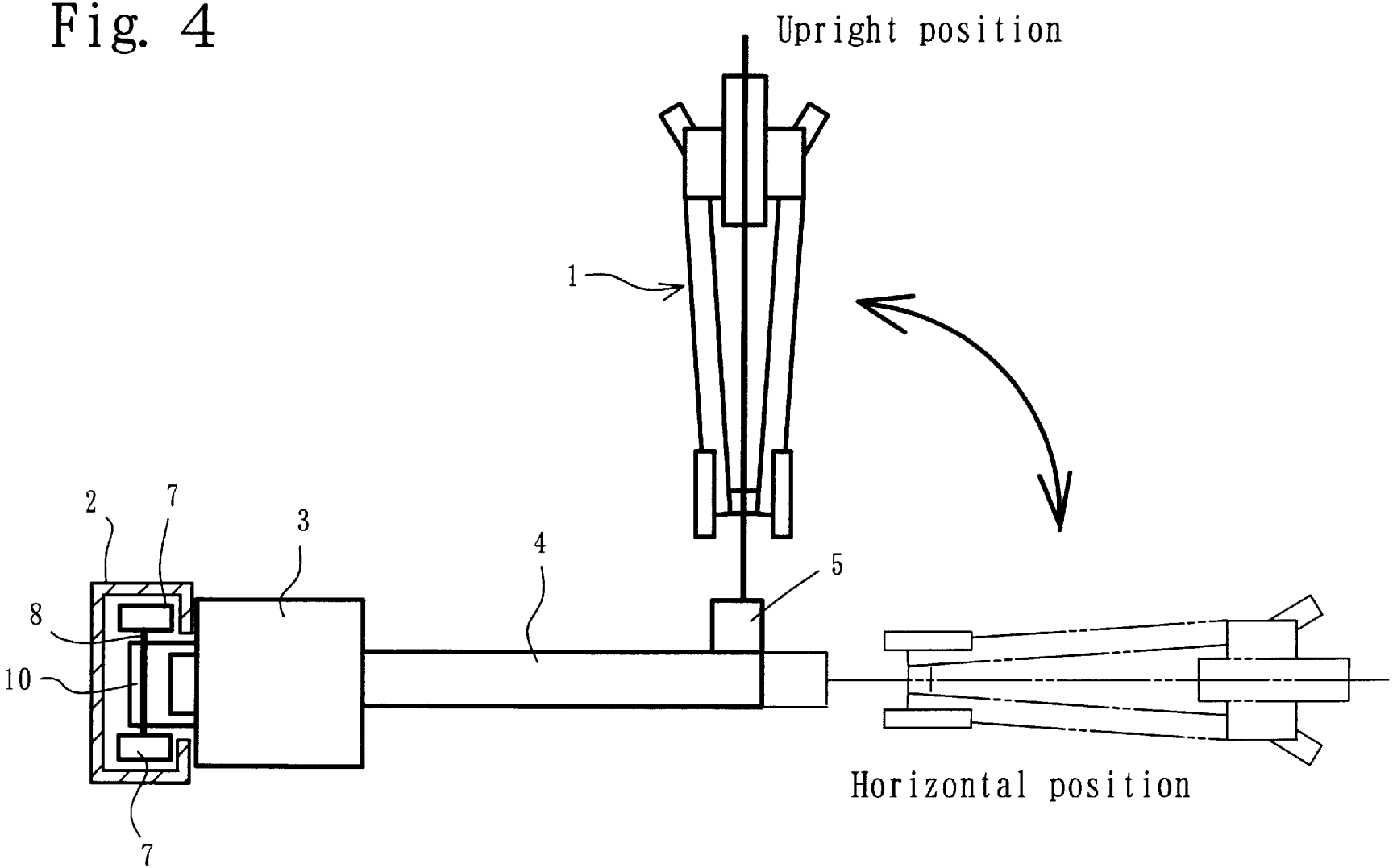
FIG. 4 is a front view thereof.

A first embodiment that has been applied to a finish coating line for a frame body of a motorcycle will be described hereunder with reference to the accompanying drawings. FIG. 1 is a view showing the coating process and FIG. 2 is side view showing a supporting condition of a workpiece 1 in the floor conveyor position. FIG. 3 is a plan view thereof and FIG. 4 is a front view showing the workpiece 1 from the direction of travel F.

First, a conveyance apparatus for the workpiece 1 will be explained. As shown in these figures, a carrier 3 is moveably supported on one side of a conveyor 2 in the longitudinal direction thereof. A rotational shaft 4 which substantially extends in a level plane laterally from the carrier 3 is rotatable 360° around the axis. One end of a vertical arm 5 is connected at right angles to an end of the rotational shaft 4, and the other end of the vertical arm 5 supports a center lower portion 1*b* of the workpiece 1. A front portion 1*a* of the workpiece 1 is fixedly secured to an end of an auxiliary stay 6 that extends in a bent condition from the vertical arm 5.

With this construction, the workpiece 1 is situated laterally away from the carrier 3 and the conveyor 2. The workpiece 1 is supported in an upright condition, i.e. in the condition in which the motorcycle is operated, within a plane parallel to the direction of travel F and within a plane parallel to the vertical direction at right angles to the direction of travel F (hereinafter referred to as "a vertical plane"). The workpiece 1 is vertically rotatable by the rotational shaft 4 in the same vertical plane.

The vertical arm 5 is moveable between an upright position where it is substantially at right angles to the rotational shaft 4 and a level position where it is substantially parallel to the rotational shaft 4. With this construction, the workpiece 1 is moveable within another plane crossing at right angles to the vertical plane and substantially parallel to the rotational shaft 4 and a vertical line (hereinafter referred to as "a horizontal plane"). When the workpiece 1 is rotated substantially 90° from the upright position, it reaches the side conveyor position substantially in a level plane (see the imaginary line condition of FIG. 4). A position control mechanism including a vertical rotation mechanism and a horizontal rotation mechanism is provided to control these workpiece positions.

Figure 5:
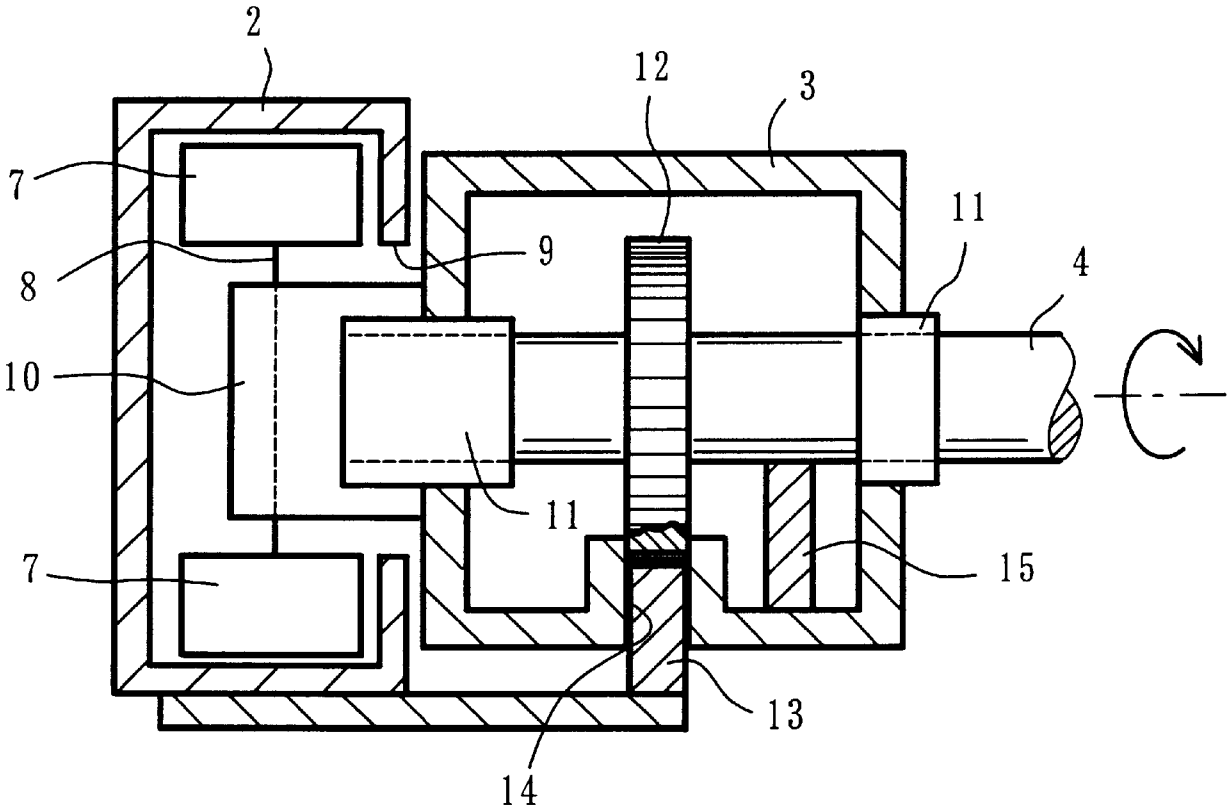
FIG. 5 is a cross sectional view showing essential parts of a vertical rotation mechanism.
Figure 6:
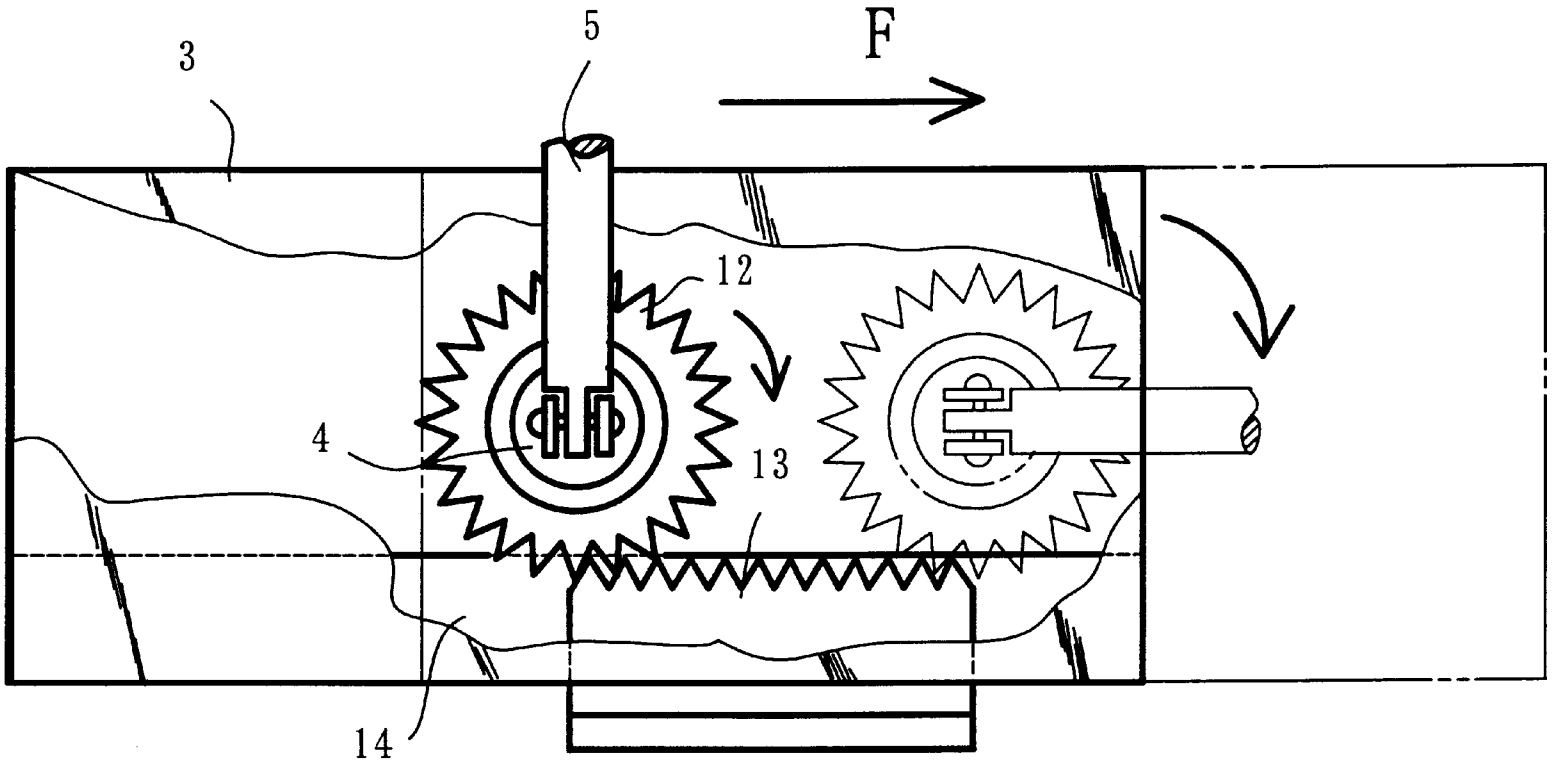
FIG. 6 is a side view thereof.

FIG. 5 is a cross sectional view of essential parts for explaining the vertical rotation mechanism and FIG. 6 is a view showing the vertical rotation mechanism from the direction of the rotational shaft 4. In these figures, the conveyor 2 is in the form of a guide rail of a substantially C-shaped cross section in which a pair of rollers 7 is housed, one roller above the other. Each roller 7 is connected to the other by a roller shaft 8 and adapted to travel in the longitudinal direction of the conveyor 2 by a driving means (not shown) such as a cable which is housed throughout the length of the conveyor 2.

Four rollers are provided in two locations before and after the carrier 3, above and below relative to the carrier 3. The rollers 7 are supported on a connecting portion 10 of the carrier 3 projecting inside the conveyor 2 through a slit 9 continuously formed in the longitudinal direction in the side of the conveyor 2 facing the carrier 3.

The carrier 3 is a box-like member with its long side extending to the front and rear. The rotational shaft 4 passes through the central portion of the carrier 3 and is rotatably supported by bearings 11 at locations where this shaft crosses the carrier 3. The rotational shaft 4 within the carrier 3 is integrally provided with a pinion 12 around the middle portion between the right and left bearings 11 which engages a rack 13 arranged at the lower part of the carrier 3. The rack 13 is disposed parallel to the conveyor 2 and fixedly secured to the conveyor 2. The rack 13 also fits into a groove 14 passing through a bottom portion of the carrier 3 in the front and rear direction.

When the carrier 3 travels in a condition in which the pinion 12 has engaged the rack 13, the pinion 12 rotates. As a result, the rotational shaft 4 integrally formed with the pinion 12 rotates and the vertical arm 5 integrally formed with the rotational shaft 4 rotates, thereby vertically rotating the workpiece 1 which is supported by the vertical arm 5. The angle of rotation of the workpiece 1 corresponds to that of the pinion 12, which relates to the distance that the pinion 12 and the rack 13 travel upon their engagement.

The rack 13 may be continuously provided over the length of the conveyor 2 or may be provided at suitable intervals for each length corresponding to an angle of rotation required for each location necessary to rotate the rotational shaft 4. When the rack 13 is continuously provided throughout the length of the conveyor 2, the workpiece 1 moves while continuously undergoing vertical rotation and therefore each process is adapted to agree with the cycle of this vertical rotation.

On the contrary, when the rack 13 is intermittently provided at any optional locations, the workpiece 1 can be vertically rotated only in the necessary process according to the continuing processes. If there is any process in which the vertical rotation of the workpiece 1 is not required, the rack 13 is not required and the pinion 12 is released from engagement with the rack 13. However, in this case, to maintain a predetermined workpiece position, it is necessary to control the rotation of the rotational shaft 4. For example, the rotation can be controlled by a suitable control means such as a brake 15 that is provided within the carrier 3.

Figure 7:
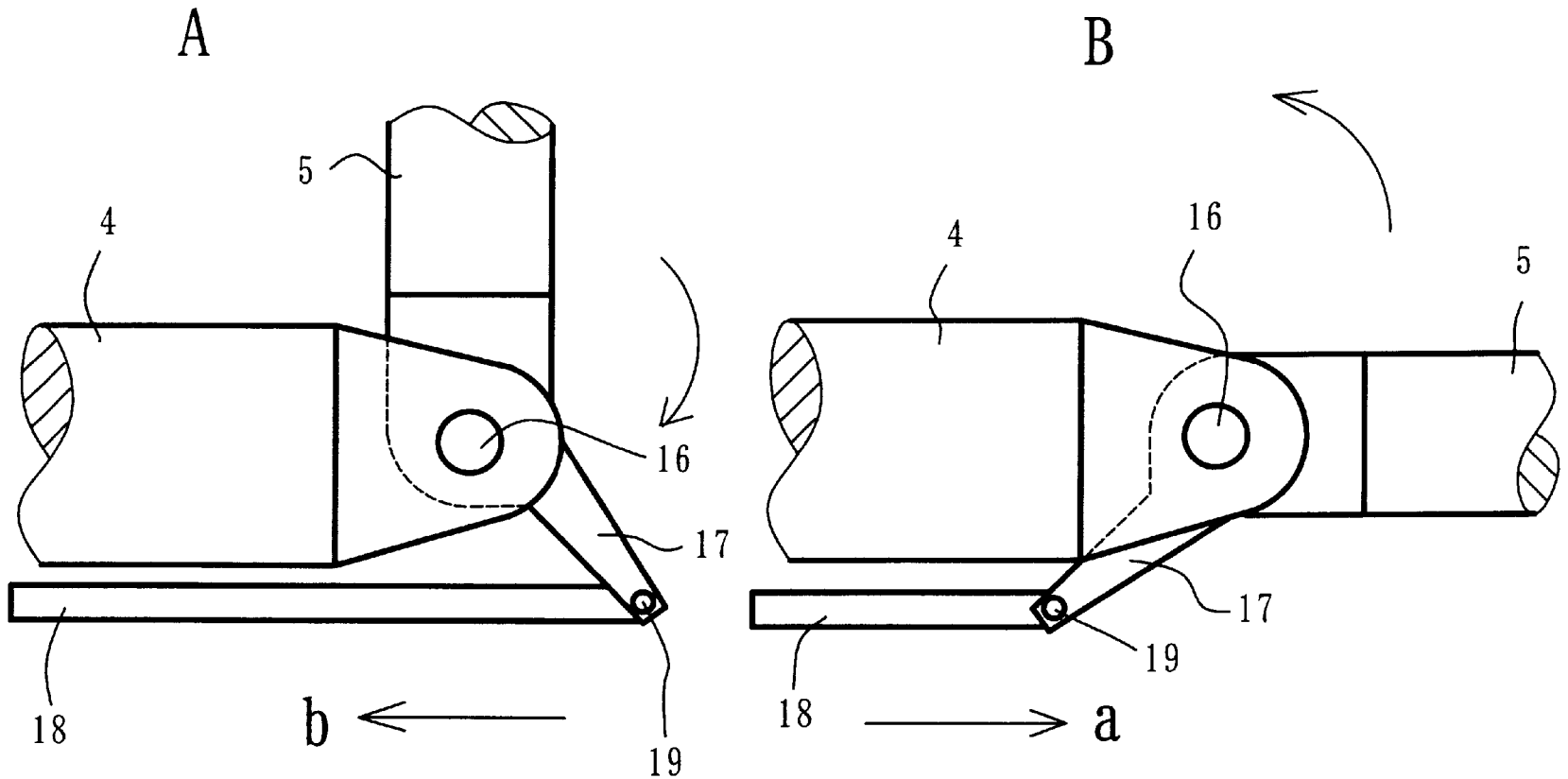
FIG. 7 is a view showing a horizontal rotation mechanism.

FIG. 7 shows the horizontal rotation mechanism in which the ends of the rotational shaft 4 and the vertical arm 5 are interconnected by a pivot 16 so as to allow the vertical arm 5 to stand upright or be positioned in a level plane. The end of the vertical arm 5 is integrally provided with a projection 17 extending therefrom and the projecting end of the projection 17 is connected to one end of a control rod 18, provided substantially parallel to the rotational shaft 4, by a pivot 19.

The other end of the control rod 18 is not shown here, but is connected to a control member provided within the carrier 3. When the control rod 18 is pushed by the control member to the right-hand side of the figure (in the direction of the arrow a), the vertical arm 5 is caused to stand upright (FIG. 7A) so as to allow the workpiece 1 to stand upright. On the contrary, when the control rod 18 is pulled to the left-hand side of the figure (in the direction of the arrow b), the vertical arm 5 is caused to be positioned in a level plane (FIG. 7B). The workpiece 1 is then caused to occupy the side conveyor position (see FIG. 4).

The workpiece position control of the side conveyor in a finish coating line will now be explained with reference to FIG. 1. FIG. 1A is a view showing the change of the workpiece position from the side thereof. FIG. 1B is a plan view thereof. In this finish coating line, a spray type coating is performed. In a finish spray booth 30, two spray apparatuses 31 and 32 of which the nozzle positions differ in height are arranged at fixed intervals along the direction of travel, wherein the spray coating is performed by the nozzles 33 and 34 from the top, respectively.

The conveyor 2 is disposed outside the spray booth 30 and only the workpiece 1 is arranged to move within the spray booth 30. The workpiece 1 first enters the spray booth 30 in the floor conveyor position (①) and vertically rotates to the overhead conveyor position in which the bottom portion of the workpiece 1 faces upward. Under-side painting of the bottom portion of a frame body is performed by a spray apparatus 31 of which the nozzle position is lower (②). Then, the side conveyor position where the left-hand side of the body faces upward is brought by the horizontal rotation mechanism, wherein an L-side coating is performed on the left-hand side of the body by the same spray apparatus 31 as above (③).

Subsequently, the body in the side conveyor position is vertically rotated 180° to allow the right-hand side of the body to face upward after which an R-side coating is performed on the right-hand side of the body by a spray apparatus 32 of which the nozzle position is higher (④). Further, from this condition, the body is placed upright by the horizontal rotation mechanism so as to return to the original floor conveyor position, wherein a top-side coating is performed on the upper surface of the body by the spray apparatus 32 (⑤). The workpiece 1 in the floor conveyor position then exits out of the spray booth 30.

Thus, by controlling the workpiece position through the combination of vertical rotation and horizontal rotation, each surface of the upper and lower and right and left of the body can be spray-coated wherein each surface to be coated faces upward. Namely, it is possible to spray-coat all surfaces to be coated in a level plane where each surface is positioned in a level plane to face the nozzles 33 and 34 situated above. It is further possible to control the workpiece position so that the workpiece 1 is situated in the best position for spray coating. As a result, even in a type of conveyance such that the workpiece 1 is conveyed by the conveyor 2 within the spray booth 30, it is possible to solve the disadvantage that an area which is not suitable for coating is left behind, to realize efficient and high quality finish coating.

Even when the workpiece 1 must be changed to the floor conveyor position and the overhead conveyor position while being continuously conveyed, it is no longer necessary to transfer the carrier 3 to a floor conveyor or an overhead conveyor each time. Also, since the workpiece position can be continuously changed while supporting the carrier 3 on the same conveyor 2, it is possible to remarkably reduce the time required for changing the workpiece position. As a result, it is also possible to reduce the loss of time required for the change of the workpiece position and to realize an efficient painting process.

In this finish coating, the workpiece 1 is constantly supported at a remote position laterally away from the conveyor 2. It is therefore possible to remarkably reduce the possibility of dust and the like from the conveyor 2 adhering to the workpiece 1 and also to enhance the coating quality in the finish coating. Since the conveyor 2 and the carrier 3 can be arranged outside the spray booth 30, it is also possible to prevent paint from adhering to them.

Figure 8:
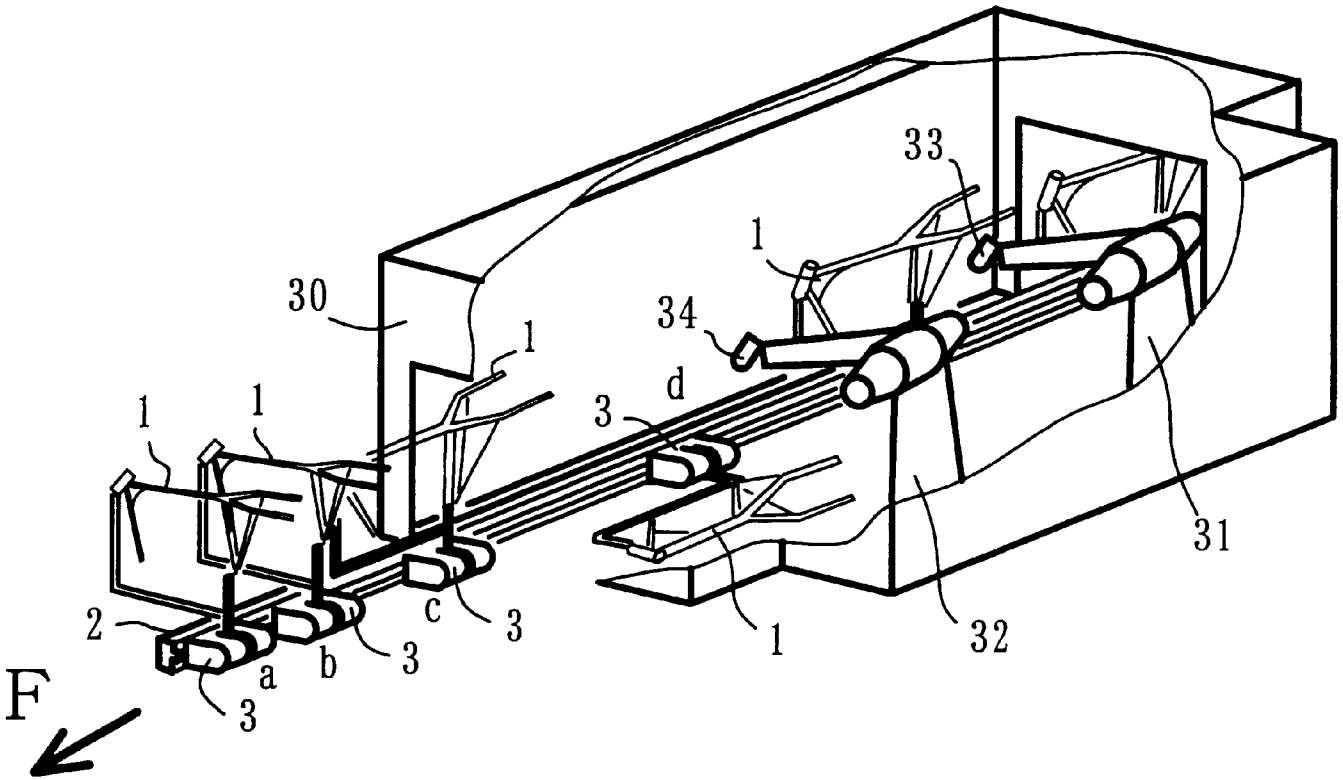
FIG. 8 is a perspective view according to a second embodiment (FIGS. 8 to 9)
Figure 9:
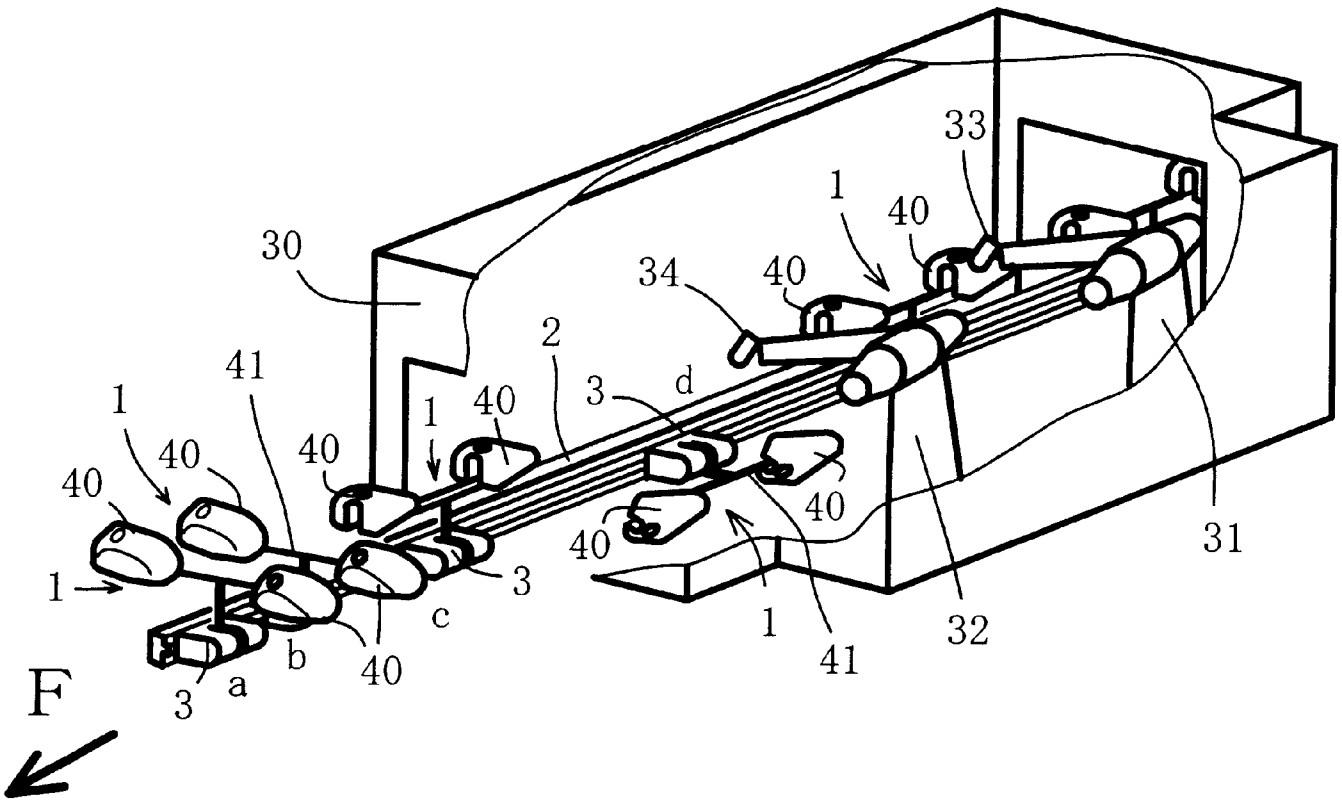
FIG. 9 is a perspective view according to the second embodiment.

FIGS. 8 and 9 show a second embodiment. FIG. 8 shows a case where the workpiece is the frame body of a motorcycle, as shown in the first embodiment, and FIG. 9 shows a case where the workpiece is a fuel tank. In FIG. 8, the carrier 3 is supported on one side of the conveyor 2 in a variable-pitch form. When the workpieces 1 that have exited out of the spray booth 30 are marked a, b, c, . . . in sequence, the workpiece 1 marked d which is being spray-coated within the spray booth 30 is situated at sufficient intervals before and after the subsequent and previous workpieces 1. The workpiece 1 marked d is so arranged as not to cause painting failure by coming too close to the adjacent workpieces 1.

On the other hand, the workpiece 1 marked c that has just come out of the spray booth 30 after coating is completed is changed to the floor conveyor position, which is a basic workpiece position. Then, the front and rear direction of the workpiece 1 in this case corresponds to the direction of travel F and is the same direction as that of the workpiece 1 marked d undergoing coating. However, the workpiece 1 marked c starts to change its position so that this workpiece 1 is positioned in the horizontal direction crossing at right angles to the direction of travel F and quickly approaches the workpiece 1 marked b narrowing the space therebetween.

The workpiece 1 marked b that has exited out of the spray booth 30 has already changed to the horizontal position and closely approaches the workpiece 1 marked a which moves ahead in the horizontal position and maintains a suitable space therebetween. Thus, by making the pitch variable, it is possible to sufficiently widen the space between preceding and subsequent carriers within the spray booth 30 so that the workpiece position most suitable for coating can be secured and to space these workpieces 1 comparatively closer outside the spray booth 30 so that the conveyance efficiency can be improved.

An arm for supporting the workpiece 1 that is provided on the carrier 3 is arranged to allow horizontal and vertical rotation around one shaft and free change of the workpiece position. The arm can be controlled to cause the surfaces to be coated from a suitable angle according to the conditions of each spray apparatus 31 and 32 such as the direction of the nozzles 33 and 34.

FIG. 9 shows the same apparatus as FIG. 8, in which an example for coating a fuel tank is shown. In this case, since coating of the bottom surface of the fuel tank can be omitted, the overhead conveyor position is not required for bottom surface coating. Accordingly, the workpieces 1 are composed of two fuel tanks 40 that are integrally connected by a connecting rod 41. A pair of fuel tanks 40 and 40 is conveyed within the spray booth 30 in a line in the direction of travel. Their positions can be controlled between the floor conveyor position and the side conveyor position so that the surfaces to be coated are most suitably positioned with respect to the spray apparatuses 31 and 32 while the distance and angles are changed.

On exiting out of the spray booth 30, the workpiece 1 is rotated 90° around a vertical axis so that two fuel tanks 40 and 40 are situated to the right and left and the front and rear spaces between the carriers are reduced as a result of the variable pitch. Thus, it is possible to select the most suitable workpiece position according to the content of the workpiece 1.

It is to be noted that workpiece position control according to the present invention is not limited to a spray type finish coating line, but can be applied, for example, to each type of treatment process such as pretreatment and electrodeposition coating in the coating line. Position control can be performed so that the surface to be treated is in the most suitable condition for treatment. Further, the present invention can be applied not only to a car body coating line, but also to various treatments such as an assembly line for a car body where continuous workpiece position control is required.

What is claimed is:

1. A conveyance apparatus for spray-coating a workpiece which is supported on a conveyor by means of a carrier while passing through a spray booth, wherein a position control mechanism which is capable of changing the position of the workpiece on a horizontal surface of the conveyor is provided, and the workpiece position is controlled by the position control mechanism so that all surfaces to be coated are turned to face a nozzle of a spray device.

2. The conveyance apparatus according to claim 1, wherein the position control mechanism is capable of vertical and horizontal rotation.

3. The conveyance apparatus according to claim 1, wherein the position control mechanism is arranged so that all surfaces to be coated can be coated in a level plane.

4. The conveyance apparatus according to claim 1, wherein the workpiece is a frame body.

5. The conveyance apparatus according to claim 1, wherein the workpiece is a fuel tank.

6. A conveyance apparatus for spray-coating a workpiece which is supported on a conveyor by means of a carrier while passing through a spray booth, wherein a position control mechanism which is capable of changing the position of the workpiece to more than one of a floor conveyor position, an overhead conveyor position, or a side conveyor position is provided, and the workpiece position is controlled by the position control mechanism so that all surfaces to be coated are turned to face a nozzle of a spray device, the position control mechanism comprising a vertical rotation mechanism and a horizontal rotation mechanism provided on the conveyor.

7. The conveyance apparatus according to claim 6, wherein the workpiece is controlled through the vertical rotation mechanism and the horizontal rotation mechanism to position each surface of the workpiece to be coated in a level plane.

* * * * *